US006029024A

United States Patent [19]

Bae

[11] Patent Number: 6,029,024

[45] Date of Patent: Feb. 22, 2000

[54] DEVICE AND METHOD FOR CONTROLLING TRANSFER VOLTAGE IN AN ELECTROPHOTOGRAPHIC RECORDING APPARATUS

[75] Inventor: Byoung-Chul Bae, Kyoungsangbuk-do, Rep. of Korea

[73] Assignee: SamSung Electronics Co., Ltd., Kyungki-do, Rep. of Korea

[21] Appl. No.: 09/299,763

[22] Filed: Apr. 27, 1999

[30] Foreign Application Priority Data

Apr. 28, 1998 [KR] Rep. of Korea ..... 98/15072

[51] Int. Cl.[7] ..... G03G 15/16

[52] U.S. Cl. ..... 399/66; 399/314; 399/313

[58] Field of Search ..... 399/66, 313, 318, 399/314, 297

[56] References Cited

U.S. PATENT DOCUMENTS

| | | | |
|---|---|---|---|
| 4,262,188 | 4/1981 | Beach . | |
| 4,324,486 | 4/1982 | Nishikwawa . | |
| 4,468,113 | 8/1984 | Motohashi et al. . | |
| 4,502,056 | 2/1985 | Matsuda . | |
| 4,839,695 | 6/1989 | Yamamoto et al. . | |
| 5,006,902 | 4/1991 | Araya | 399/313 X |
| 5,036,360 | 7/1991 | Paxon et al. | 399/66 X |
| 5,099,287 | 3/1992 | Sato . | |
| 5,155,501 | 10/1992 | Fujita et al. . | |
| 5,177,531 | 1/1993 | Miyasaka et al. . | |
| 5,179,397 | 1/1993 | Ohzeki et al. | 399/297 X |
| 5,250,999 | 10/1993 | Kimura et al. . | |
| 5,287,149 | 2/1994 | Hoshika . | |
| 5,450,180 | 9/1995 | Ohzeki et al. . | |
| 5,729,267 | 3/1998 | Shimada et al. . | |
| 5,812,904 | 9/1998 | Rhee et al. . | |
| 5,848,321 | 12/1998 | Roh et al. . | |

*Primary Examiner*—Susan S. Y. Lee
*Attorney, Agent, or Firm*—Robert E. Bushnell, Esq.

[57] ABSTRACT

A device and method for controlling a transfer voltage in an electrophotographic recording apparatus for printing by the page. In the transfer voltage controlling device, a high voltage generator generates a transfer voltage, an exposer starts and stops an exposure in response to a first exposure signal and a second exposure signal, respectively, a transfer roller transfers an image by high pressure with the transfer voltage received from the high voltage generator, and an engine controller generates the first exposure signal for starting an exposure for one page and the second exposure signal for terminating the exposure for the page, and causes the high voltage generator to supply or stop the transfer voltage to the transfer roller upon generation of the first exposure signal or the second exposure signal, respectively.

12 Claims, 6 Drawing Sheets

FIG. 1 *(Prior Art)*

DEVICE AND METHOD FOR CONTROLLING TRANSFER VOLTAGE IN AN ELECTROPHOTOGRAPHIC RECORDING APPARATUS

CLAIM OF PRIORITY

This application makes reference to, incorporates the same herein, and claims all benefits accruing under 35 U.S.C. § 119 from an application for DEVICE AND METHOD FOR CONTROLLING TRANSFER VOLTAGE earlier filed in the Korean Industrial Property Office on Apr. 28, 1998 and there duly assigned Serial No. 15072/1998.

BACKGROUND OF THE INVENTION

1. Field of the Invention

The present invention relates to a device and method for controlling a transfer voltage in an electrophotographic recording apparatus for use in a copier, facsimile apparatus, and a printer, and in particular, to a device and method for controlling a transfer voltage to be fed to a transfer roller in synchronization with an exposure signal.

2. Description of the Related Art

In general, a transfer voltage is fed to a transfer roller upon insertion of a paper sheet between the transfer roller and an organic photoconductive (OPC) drum. This can result in unnecessary power dissipation and can reduce the life of the organic photoconductive drum upon application of a high voltage to the organic photoconductive drum, despite the presence of the paper sheet between the organic photoconductive drum and the transfer roller. Another problem that can occur is the possible application of a transfer voltage without proper introduction of the paper sheet between the transfer roller and the organic photoconductive drum which can damage the sensitive surface of the organic photoconductive drum, and further, can degrade the printing quality.

U.S. Pat. No. 4,262,188 to Beach, entitled METHOD AND APPARATUS FOR IMPROVING PRINT QUALITY OF A THERMAL PRINTER, discloses the uniformity of density of characters printed by thermal printers upon thermally sensitive paper is enhanced by controlling the amount of energy supplied to the print head during subsequent printings before the print head has completely cooled to ambient temperature. It is disclosed that to obtain the desired uniformity the energy supplied to the print head for subsequent printings is made proportional to the energy lost by cooling of the print head between printings. It is disclosed this results in the print head being reheated to substantially the same printing temperature for each printing of a character or character segment. By using a dot driver having an R-C circuit that recharges the capacitor between print pulses at a rate that is proportional to the thermal time constant of the print head, it is disclosed that the energy stored by the capacitor can then be used to re-heat, or control the re-heating, of the print head to substantially the same selected print temperature. By maintaining the R-C charging time constant substantially between 0.1 .tau.and .tau. (.tau. is the thermal time constant of the print head) it is disclosed the resultant print character segments have substantially uniform density.

U.S. Pat. No. 4,324,486 to Nishikawa, entitled RECORDING DEVICE INCLUDING A HEATING MEANS, discloses a recording device having a heating unit operated and controlled to a predetermined operating temperature, the start of the recording device being governed so as not to operate the heating unit before its temperature reaches a predetermined operating value, the starting of the recording device being permitted prior to a certain time before the temperature of the heating unit reaches the predetermined operating value after the power supply is energized source for the recording device.

U.S. Pat. No. 4,468,113 to Motohashi et al., entitled TRANSFER TYPE ELECTROSTATIC REPRODUCING APPARATUS, discloses an electrostatic reproducing apparatus provided with a transfer paper thickness detecting element and/or a transfer paper size detecting element and an exposure device between the development device and the transfer device. The quantity of light to be irradiated onto the photosensitive member from the exposure device is disclosed to be adjusted according to a paper thickness information of the paper thickness detecting element and/or a paper size information of the transfer paper size detecting element. The paper thickness detecting element is disclosed to comprise a light emitting element and a light receiving element, and the paper size detecting element is also disclosed to comprise a magnet mounted on a paper feeding cassette and a lead switch mounted on the apparatus body side correspondingly thereto.

U.S. Pat. No. 4,502,056 to Matsuda, entitled TEMPERATURE CONTROL SYSTEM, discloses a temperature control system for a thermal printer which prints by urging a printing plate with type formed thereon against a heat-transfer paper sheet. It is disclosed that the system raises the temperature of the printing plate rapidly after power is turned on and then maintains the temperature of the printing plate essentially constant at the optimal temperature, so that clear printing can be performed at any time. In the initial heating period of the printing plate, a high voltage is applied to the printing plate to raise the temperature quickly. It is disclosed when a first sensor detects that the printing plate has reached a temperature close to the optimal printing temperature, the high voltage supply is interrupted. Thereafter, a second sensor and a control circuit connected thereto are disclosed to serve to produce a low voltage that is applied so as to maintain the printing plate at the optimal printing temperature. It is also disclosed that the magnitude of the low voltage is inversely proportional to printing plate temperature.

U.S. Pat. No. 4,839,695 to Yamamoto et al., entitled DEVICE FOR CONTROLLING CHARGE AREA OF PHOTORECEPTOR, discloses a device for controlling the charge area of a photoreceptor including a detector for detecting the length of a sheet of copying paper, another detector for detecting the length of an image projected area of the photoreceptor, a selecting device for selecting the shorter one between the detected length of the copying paper sheet and that of the image projected area by comparing them with each other, and controls for controlling the charging time of the main charger so as to charge the photoreceptor to an area corresponding to a length selected by the selecting device, whereby the charge area of the photoreceptor is properly controlled so as to correspond to an area necessary to be transferred, even when the length of the image projected area on the photoreceptor differs from that of the coping paper sheet.

U.S. Pat. No. 5,099,287 to Sato, entitled TRANSFERRING VOLTAGE CONTROL SECTION, discloses an electrophotographic printing apparatus including a paper supplying mechanism for supplying recording paper, and a transferring section for charging the recording paper supplied from the paper supplying mechanism by means of a transferring voltage and for transferring development material adhered to the surface of a charging body of the apparatus to the charged recording paper. It is further disclosed that the electrophotographic printing device also includes a transferring voltage control section for controlling the transferring voltage level according to the type of the recording paper.

U.S. Pat. No. 5,155,501 to Fujita et al., entitled ELECTROPHOTOGRAPHIC APPARATUS WITH FREQUENCY AND DUTY RATIO CONTROL, discloses an electrophotographic apparatus wherein a photosensitive body charged by a charger is exposed to light emitted from an exposer, for the formation of an electrostatic latent image, and wherein the electrostatic latent image is developed by a developer and the image developed by the developer is transferred on a paper sheet by a transfer charger. The transfer charger of the apparatus is disclosed to be made up of a converter transformer, a switching circuit for controlling the excitation of the converter transformer, and an error detector, arranged in association with the converter transformer, for detecting an error voltage corresponding to a transfer voltage. The apparatus is disclosed to have a separately (or externally) excited converter which outputs the transfer voltage from the secondary winding of the converter transformer, and input section from which one of the print density levels that are predetermined stepwise is designated, and a control section for controlling the frequency and duty ratio of a transfer signal used for causing the switching circuit to perform a switching action, in accordance with the print density level designated from the input section and the error voltage information supplied from the error detector.

U.S. Pat. No. 5,177,531 to Miyasaka et al., entitled ELECTROSTATIC RECORDER AND ELECTROSTATIC LATENT IMAGE MEASURING INSTRUMENT, discloses an electrostatic recorder including an electrostatic latent image measuring instrument for measuring a state of an electrostatic latent image formed on a photosensitive substance, and executing a printing process until an electrostatic latent image formed on a surface of a photosensitive substance based on measured data is transferred onto a blank form as a visual image by a transfer device by adjusting control factors such as exposure, exposure time, electrostatic charge voltage, development bias, temperature and humidity. It is also disclosed that the electrostatic latent image measuring instrument is provided with distance sensors which, when a measuring electrode is disposed near to the photosensitive substance, maintains a constant distance therebetween.

U.S. Pat. No. 5,250,999 to Kimura et al., entitled IMAGE FORMING APPARATUS HAVING TRANSFER VOLTAGE AND PROCESS SPEED CONTROL, discloses a color image forming apparatus for forming a toner image on a transparent member used in combination with overhead projectors including a speed switch for switching the process speed while an image carrier is rotating, after toner images of a number of colors are formed on the image carrier; a process control for controlling the transfer conditions under which the toner images are transferred onto the recording medium, in response to switching of the process speed; and a selector for selecting an overhead projection mode including a voltage switch for reducing voltage applied to the transfer device after a predetermined time has elapsed. It is also disclosed that the process control preferably includes a fixing temperature control for controlling the fixing temperature of the recording medium having the toner images transferred thereon.

U.S. Pat. No. 5,287,149 to Hoshika, entitled IMAGE FORMING APPARATUS HAVING IMAGE TRANSFER ELECTRODE CONTACTABLE TO TRANSFER MATERIAL, discloses an image forming apparatus including an image bearing member for bearing a toner image, movable along an endless path, an original supporting platen for supporting an original, an illumination source for illuminating an original on the supporting platen, an image forming device including a charger, an exposure optical system, including a reciprocable part for directing a light image of the original on the supporting platen, a developing device and an image transfer device, wherein the reciprocable part moves in a first direction, during an image formation, in which the light image is directed to the image bearing member for image formation thereon and in a second direction, during non-image-formation, for returning the part, and wherein the illumination source emits light both during the image formation an during the non-image-formation to direct the light image to the image bearing member, and wherein a developing bias voltage in the developing device is switched depending on whether the apparatus is in the image formation or in the non-image-formation so that an image formed on the image bearing member is not developed by the developing device during the non-image-formation.

U.S. Pat. No. 5,450,180 to Ohzeki et al., entitled IMAGE FORMING APPARATUS HAVING CONSTANT CURRENT AND VOLTAGE CONTROL IN THE CHARGING AND TRANSFER REGIONS, discloses an image forming apparatus including a movable image bearing member, an image forming device for forming an image on the image bearing member, a charging member disposed opposed to the image bearing member, and bias application device for applying a bias voltage to the charging member, wherein the bias applying device effects a constant voltage control to the charging member when an image area of the image bearing member is in a charging region of the charging member and effects a constant current control during at least a part of a period in which an area of the image bearing member other than the image area is in the charging region, and wherein a level of a constant voltage of the constant voltage control is determined during the constant current control.

U.S. Pat. No. 5,729,267 to Shimada et al., entitled IMAGE FORMING APPARATUS HAVING IMAGE TRANSFER WITH TONER CLEANING FUNCTION, discloses an image forming apparatus having a photosensitive drum, a charger for uniformly charging the photosensitive drum, an exposing means for forming an electro-static latent image on the photosensitive drum, an exposing unit for forming a visual image by developing the electro-static latent image, a transfer roller for transferring the visual image to a printing medium, which includes a transfer voltage supply circuit that supplies the transfer roller one or more times with voltage in one polar direction and successively in the other polar direction during an interval after starting of operation of the image forming apparatus and before the time when the printing medium is transported to the transfer roller.

U.S. Pat. No. 5,812,904 to Rhee et al., entitled IMAGE FORMING APPARATUS AND METHOD FOR CONTROLLING CHARGING POTENTIAL DIFFERENTLY BETWEEN IMAGE FORMING AREA AND NON-IMAGE FORMING AREA OF PHOTOSENSITIVE DRUM, discloses a system for controlling a potential of a photosensitive drum for a laser beam printer having a photosensitive drum on which an electrostatic image is formed, a charger for applying voltages differentially to an image forming area where the photosensitive drum contacts a recording medium and to a non-image forming area where the photosensitive drum does not contact the recording medium to charge the outer surface of the photosensitive drum to a given polarity, a light scanner unit for forming an electrostatic latent image on the drum corresponding to image data, and a developing unit for applying toner onto the photosensitive drum during the image forming area and a transfer charger for transferring a toner image formed on the drum to the recording medium. It is further disclosed that the system also includes a potential controlling unit for applying a first charging potential to the photosensitive drum during the image forming area to charge the photosensitive drum to a given voltage for development, and for applying a second charging potential to the photosensitive drum during the non-image forming area.

U.S. Pat. No. 5,848,321 to Roh et al., entitled METHOD FOR AUTOMATICALLY CONTROLLING TRANSFER VOLTAGE IN PRINTER USING ELECTROPHOTOGRAPHY SYSTEM, discloses an electrophotography machine that produces images of optimum image density regardless of whether an ordinary sheet of paper or a transparency is used as the recording medium. It is disclosed that a photosensor activated in response to the recording media passing a first sensor is positioned on the paper conveyance path and detects whether or not the recording media being processed is an ordinary sheet of paper or a transparency, and that a controller automatically applies the appropriate transfer voltage depending on whether or not the sheet of recording media is a sheet of paper or a transparency.

SUMMARY OF THE INVENTION

An object of the present invention, therefore, is to provide a device and method for controlling a transfer voltage, which can minimize damage to an organic photoconductive drum and reduce power consumption.

To achieve the above object and other objects of the present invention, there is provided a device and a method for controlling a transfer voltage in an electrophotographic recording apparatus for printing by the page. According to one aspect of the present invention, in the transfer voltage controlling device, a high voltage generator generates a transfer voltage, an exposer starts and stops an exposure in response to a first exposure signal and a second exposure signal, respectively, a transfer roller transfers an image by high pressure with the transfer voltage received from the high voltage generator, and an engine controller generates the first exposure signal for starting an exposure for one page and the second exposure signal for terminating the exposure for the page, and causes the high voltage generator to supply or stop the transfer voltage to the transfer roller upon generation of the first exposure signal or the second exposure signal, respectively.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
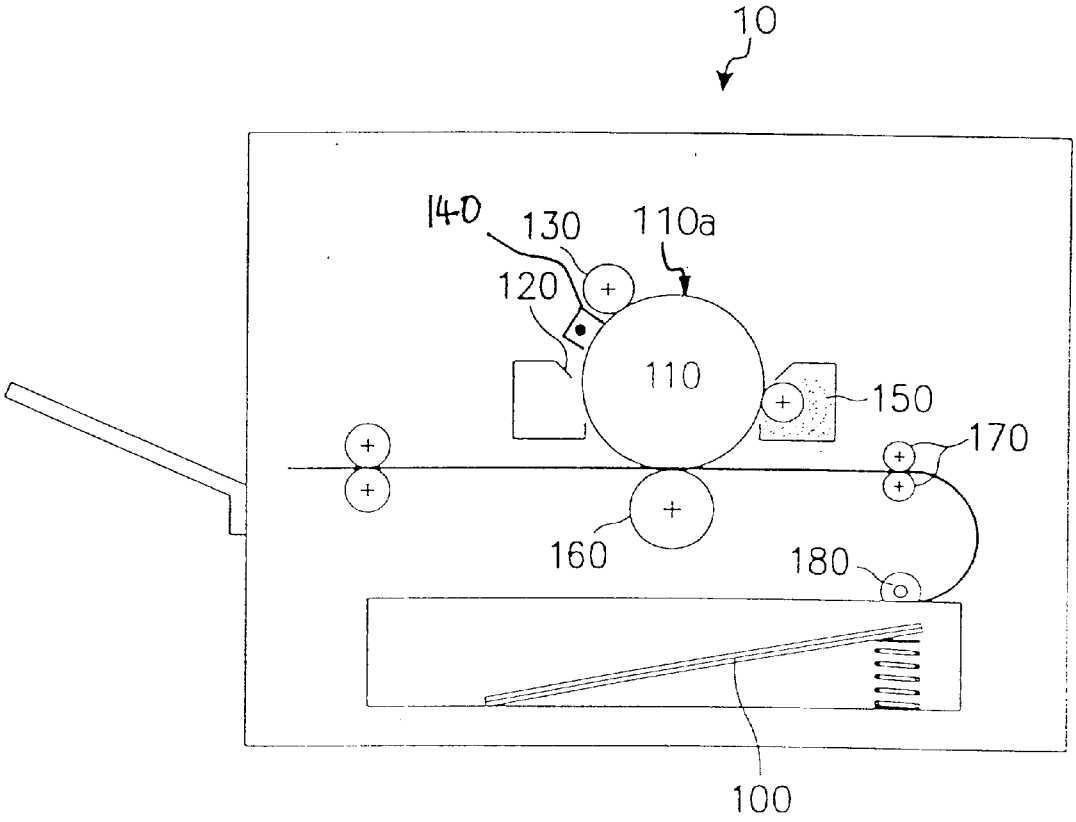
FIG. 1 is a schematic view of an electrophotographic recording apparatus to which the present invention is applied.

Referring to FIG. 1, a printing operation in a typical electrophotographic recording apparatus 10 to which the present invention is applicable, such as a copier, facsimile apparatus or a printer, for example, will be described. Referring to FIG. 1, the surface 110*a* of an organic photoconductive (OPC) drum 110 is uniformly charged with electricity by a corona discharge of a charging roller 130. An exposer 140 exposes the surface of the organic photoconductive drum 110 upon reception of an electrical signal for forming an image on the charged portion of the organic photoconductive drum 110. Then, an electrostatic latent image is formed on the initially charged and then exposed portion of the surface 110*a* of the organic photoconductive drum 110, and developed into a visible toner image with toner by a developer 150 having a developing roller and a supply roller. In this state, a recording medium or paper sheet 100 loaded on a paper cassette is fed to a feeding roller 170 by a pickup roller 180 and then reaches a transfer roller 160 by rotation of the feeding roller 170. Then, the toner image is transferred from the surface 110*a* of the organic photoconductive drum 110 onto the paper sheet 100 with a high pressure applied onto the paper sheet 100 by the transfer roller 160. When the paper sheet 100 passes between a heating roller and a compression roller in a fixer, the image is fixed on the paper sheet 100 by heat and pressure. Finally, the printed paper sheet 100 is transferred to a discharge plate by rotation of a discharge roller.

Meanwhile, toner and an electrostatic latent image remains on the surface 110*a* of the organic photoconductive drum 110 after transferring the toner image on the paper sheet 100. The residual toner and charge are eliminated by a cleaner 120 and a charge removing lamp, respectively.

Figure 2:
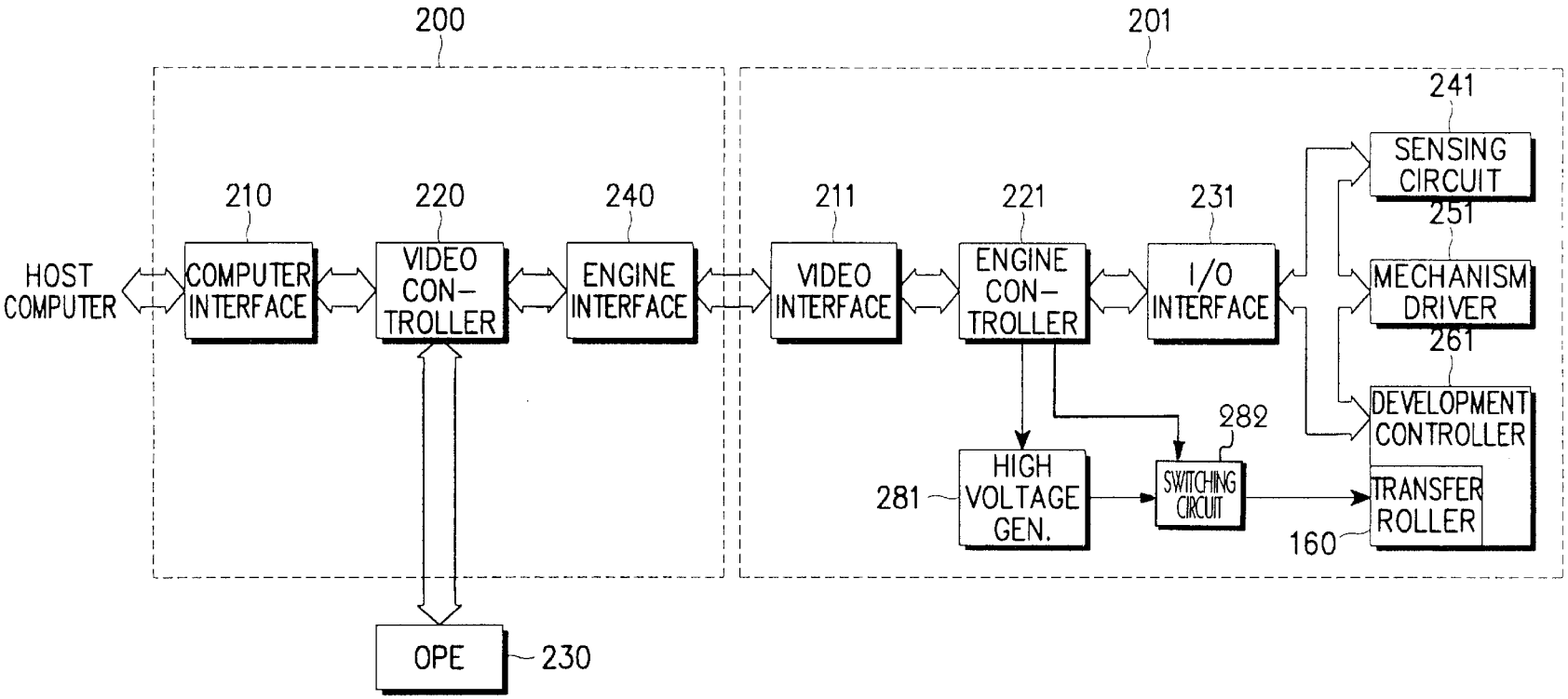
FIG. 2 is a block diagram of the electrophotographic recording apparatus shown in FIG. 1 including an engine controller according to the present invention.

FIG. 2 is a block diagram of a general laser beam printer (LBP) relying on electrophotographic development including an engine controller according to the present invention. The laser beam printer (LBP) is comprised of a video control unit 200, a print engine 201, and an OPE (Operation Panel Equipment) 230.

The video control unit 200 includes a computer interface 210 for interfacing an input/output signal with a host computer, a video controller 220, and an engine interface 240. The video controller 220 has a random access memory (RAM) for temporarily storing data received from the host computer and the operation panel equipment (OPE) 230 and has a read-only memory (ROM) for storing a control program according to the present invention, and changes data received from the computer interface 210 to image data suitable for processing in the print engine 201, according to a predetermined program. The engine interface 240, coupled between the video controller 220 and the print engine 201, interfaces an input/output signal with the print engine 201 under the control of the video controller 220.

Continuing with reference to FIG. 2, the operation panel equipment (OPE) 230 is coupled to the video controller 220 and has a plurality of keys and a display, for feeding key data generated through the keys to the video controller 220 and displaying information related with a printing operation.

Again, continuing with reference to FIG. 2, as well as to FIG. 1, the print engine 201 is connected to the video control unit 200 and includes a video interface 211, an engine controller 221, an input/output (I/O) interface 231, a sensing circuit 241, a mechanism driver 251, a development controller 261, and a high voltage generator 281. The video interface 211 interfaces a transmit/receive signal between the video control unit 200 and the engine controller 221. Under the control of the video controller 220, the engine controller 221 causes the mechanism driver 251, the development controller 261, and the high voltage generator 281 to print an image on the paper sheet 100 based on image data received from the video controller 220, and monitors the operation of each of the above mentioned components in the print engine 201, and the transfer and sorting of the paper sheet or sheets 100. The input/output (I/O) interface 231 is coupled between the engine controller 221 and the sensing circuit 241, the mechanism driver 251, and the development controller 261, for interfacing an input/output signal of the engine controller 221. The sensing circuit 241 includes a plurality of sensors for sensing the operational status of each component part in the print engine 201, the transfer and sorting of the paper sheet 100, temperature, and humidity and feeding sensing signals from the sensors to the engine controller 221. The mechanism driver 251 drives motors and devices needed for feeding the paper sheet 100, transferring the paper sheet 100, and for printing on the paper sheet 100 under the control of the engine controller 221. The development controller 261 causes the organic photoconductive drum 110, the cleaner 120, the charging roller 130, the exposer 140, the developer 150, the transfer roller 160, and the high voltage generator 281 to print an image on the paper sheet 100, under the control of the engine controller 221.

Figure 3:
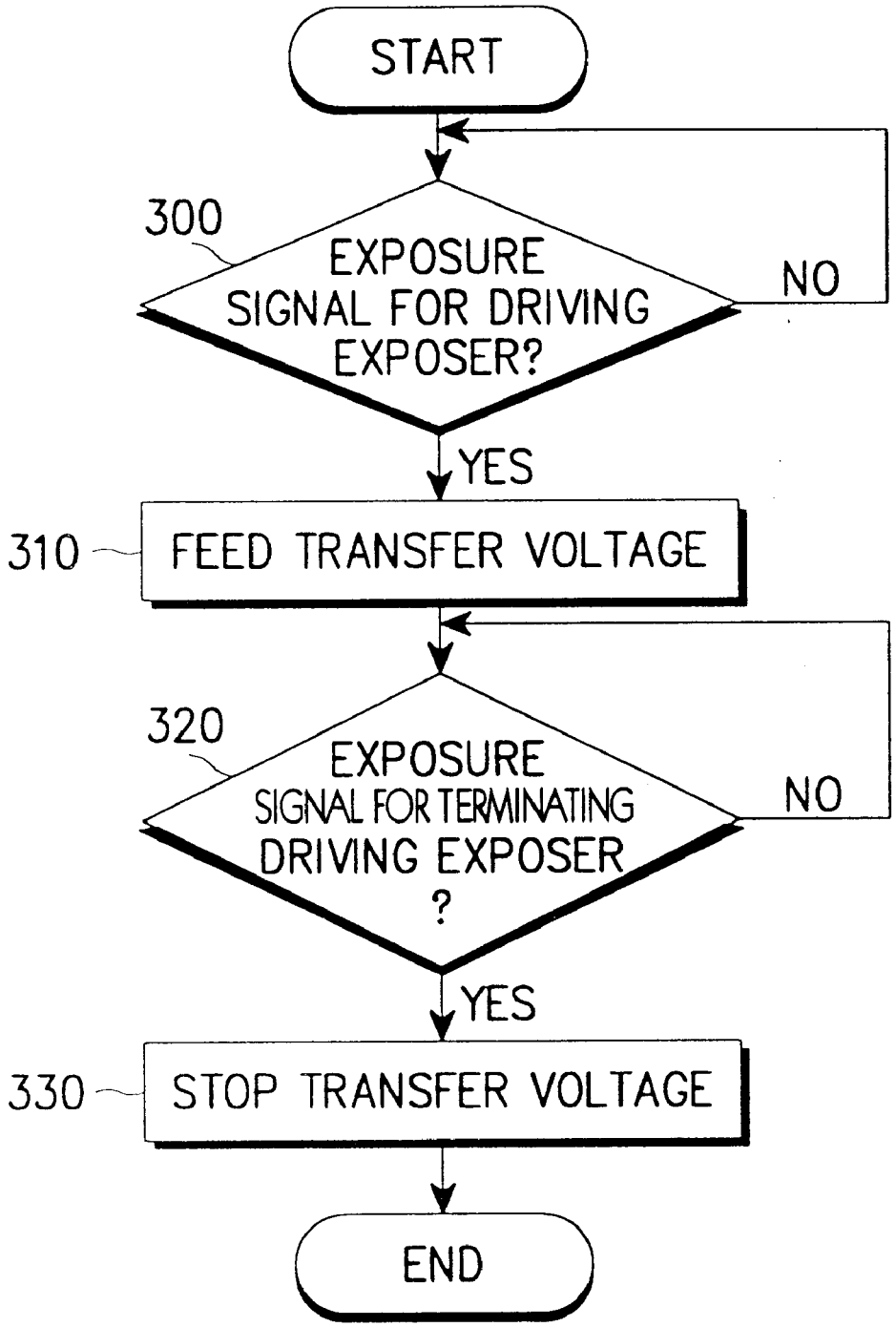
FIG. 3 is a flowchart of a control operation for feeding a transfer voltage according to an embodiment of the present invention.
Figures 4A, 4B, 4C, 4D:
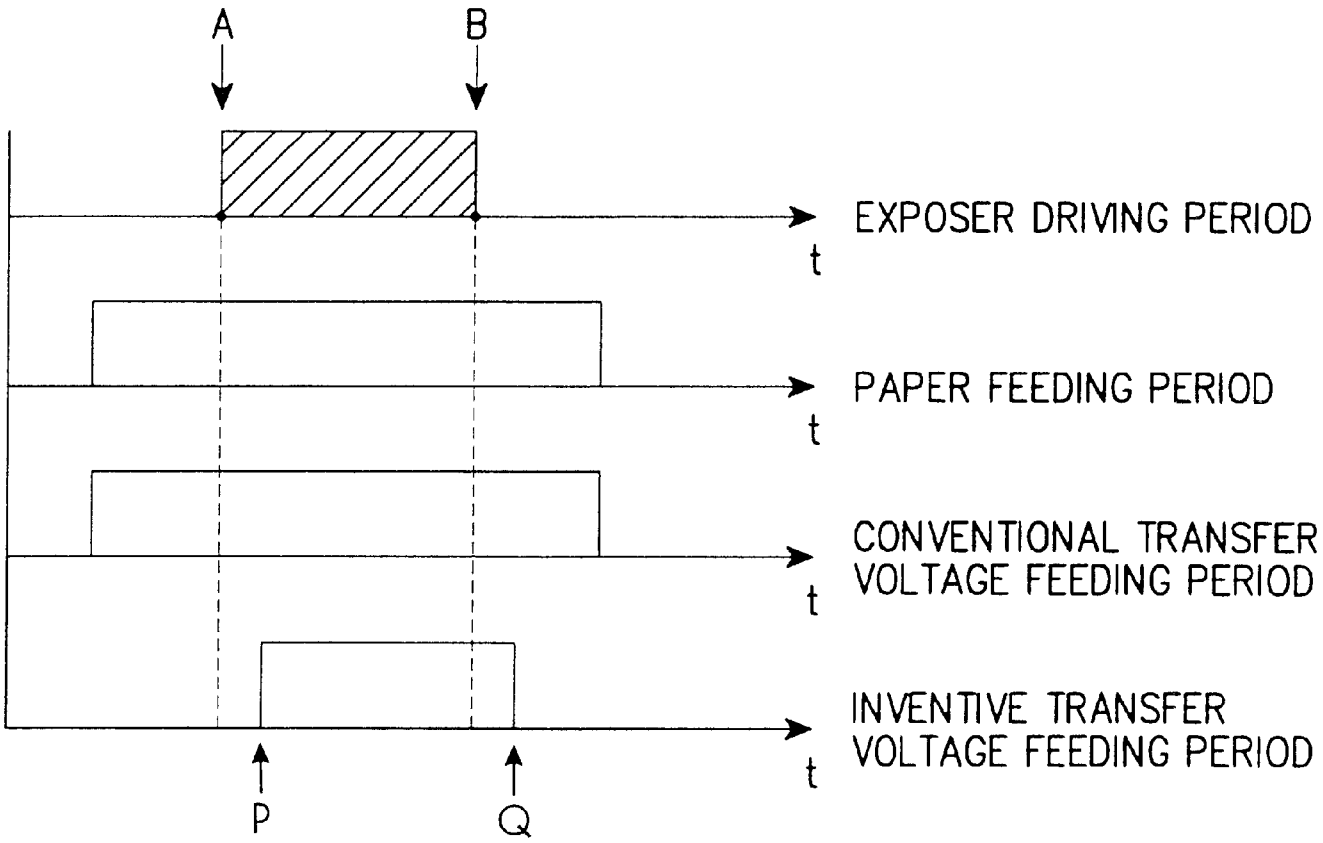
FIGS. 4A–4D are timing diagrams of signals according to an embodiment of the present invention, with FIG. 4A illustrating an exposer driving period, FIG. 4B illustrating a paper feeding period, FIG. 4C illustrating a conventional transfer voltage feeding period, and FIG. 4D illustrating a transfer voltage feeding period according to the present invention.

Referring now to FIGS. 3 and 4A–4D, FIG. 3 is a flowchart of a control operation for feeding a transfer voltage according to an embodiment of the present invention, and FIGS. 4A–4D are timing diagrams of signals according to the embodiment of the present invention, with FIG. 4A illustrating an exposer driving period, FIG. 4B illustrating a paper feeding period, FIG. 4C illustrating a conventional transfer voltage feeding period, and FIG. 4D illustrating a transfer voltage feeding period according to an embodiment of the present invention. In FIGS. 4A–4D, the arrow an the horizontal axis indicates a direction of increasing time t.

An embodiment of the method and apparatus of the present invention to now be described with reference to FIGS. 1, 2, 3, 4A and 4B is directed to provision of a transfer voltage in synchronization with an exposure signal of the exposer 140 during a period ranging from the initial driving time to the last driving time of the exposer 140, when printing a page. The video controller 220 of video control unit 200 converts print data received from the computer interface 210 to image data suitable for processing in the print engine 201, according to a predetermined program, and feeds the image data to the video interface 211. Then, the engine controller 221 drives the pickup roller 180 to pick up the paper sheet 100 and calculates the level of a transfer voltage to be variably fed to the transfer roller 160 based on values of the size and thickness of the paper sheet 100, temperature, and humidity received from the sensing circuit 241. The engine controller 221 charges the organic photoconductive drum 110 by the charging roller 130 and exposes the surface 110*a* of the organic photoconductive drum 110 based on the image data by the exposer 140. Simultaneously, referring to the flowchart of FIG. 3, the engine controller 221 determines whether an exposure signal, a first exposure signal, for driving the exposer 140 is to be output in step 300 of FIG. 3. The time when a first exposure signal is output corresponds to a point indicated by reference symbol A in an exposer driving period in FIG. 4A. In response to output of the first exposure signal at point A in FIG. 4A, the engine controller 221 provides a control signal that drives the high voltage generator 281 for starting to feed a transfer voltage to the transfer roller 160, in step 310. Here, it should be appreciated that the transfer voltage is supplied simultaneously with feeding of the paper sheet 100 in the prior art as illustrated in FIGS. 4B and 4C. In contrast, as illustrated in FIG. 4D, according to the present invention, the time at which to feed the transfer voltage to the transfer roller 160 is calculated by adding the time when the exposer 140 initially exposes the organic photoconductive drum 110 and the time required for the initially exposed portion of the organic photoconductive drum 110 to reach the transfer roller 160, and then subtracting a minimum time needed for the transfer voltage fed to the transfer roller 160 by the high voltage generator 281 to reach a stable level from the sum, these times being stored in a memory, as necessary, such as in a memory of engine controller 221. For example, if the exposure is initially executed at one minute and ten seconds past one, the initially exposed portion of the organic photoconductive drum 110 takes three seconds to reach the transfer roller 160, and the transfer voltage takes one second to reach a stable level, the transfer voltage starts to be fed at one minute twelve seconds past one, determined by equation (1) as follows:

$$\text{transfer voltage feeding time}=a+b-c \quad (1),$$

where a is the initial exposing time, b is the time required for the exposed portion of the organic photoconductive drum 110 to reach the transfer roller 160, and c is the time needed for a transfer voltage fed to reach a stable level. As previously mentioned, the transfer voltage level is calculated based on the values of the size, thickness, and resistance of the paper sheet 100, temperature, and humidity received from the sensing circuit 241, in a known way to those skilled in the art.

Then, continuing with reference to FIGS. 1, 2, 3, 4A–4D, in step 320 of FIG. 3, the engine controller 221 determines whether an exposure signal, a second exposure signal for terminating the operation of the exposer 140 is to be output. The output time of this exposure signal corresponds to a point indicated by reference symbol B in the exposer driving period in FIG. 4A. Upon output of the second exposure signal for terminating the operation of the exposer 140, the procedure goes to step 330. If the second exposure signal is not output, the engine controller 221 waits at step 320 as to output of the second exposure signal. In step 330, the engine controller 221 generates a second control signal that stops the transfer voltage from being fed from the high voltage generator 281 to the transfer roller 160. As illustrated in FIG. 4D, the time when provision of the transfer voltage is stopped is the sum of the time when the exposer 140 executes the last exposure, the time required for the last exposed portion of the organic photoconductive drum 10 to reach the transfer roller 160, and a minimum time required for completely transferring a toner image with the transfer voltage fed from the high voltage generator 281 to the transfer roller 160, these times also being stored in a memory, as necessary, such as a memory of engine controller 221. For example, if the last exposure is performed at ten minutes and twenty seconds past one, the last exposed portion of the organic photoconductive drum 110 takes three seconds to reach the transfer roller 160, and one second is consumed to transfer a toner image, the transfer voltage is stopped at ten minutes twenty-four seconds past one, determined by equation (2) as follows:

$$\text{transfer voltage stopping time}=a'+b'+d \quad (2),$$

where a' is the last exposing time, b' is the time (a last exposed portion time) required for the last exposed portion of the organic photoconductive drum 110 to reach the transfer roller 160, and d is the time (a toner image transfer time) needed for completely transferring a toner image.

In general, the exposer 140 is driven only for a print data-present portion of the paper sheet 100. A transfer voltage is applied to the transfer roller 160 while the paper sheet 100 is fed, in the prior art, whereas in the present invention, the transfer voltage is applied for a period of time similar to a period of time for the exposer driving period from A to B, the exposer driving period being illustrated in FIG. 4A. However, in the present invention, from and as illustrated in FIG. 4D, it can be inferred that a transfer voltage supplying or feeding period from P to Q is delayed for the above-described reasoning and discussion.

Figure 5:
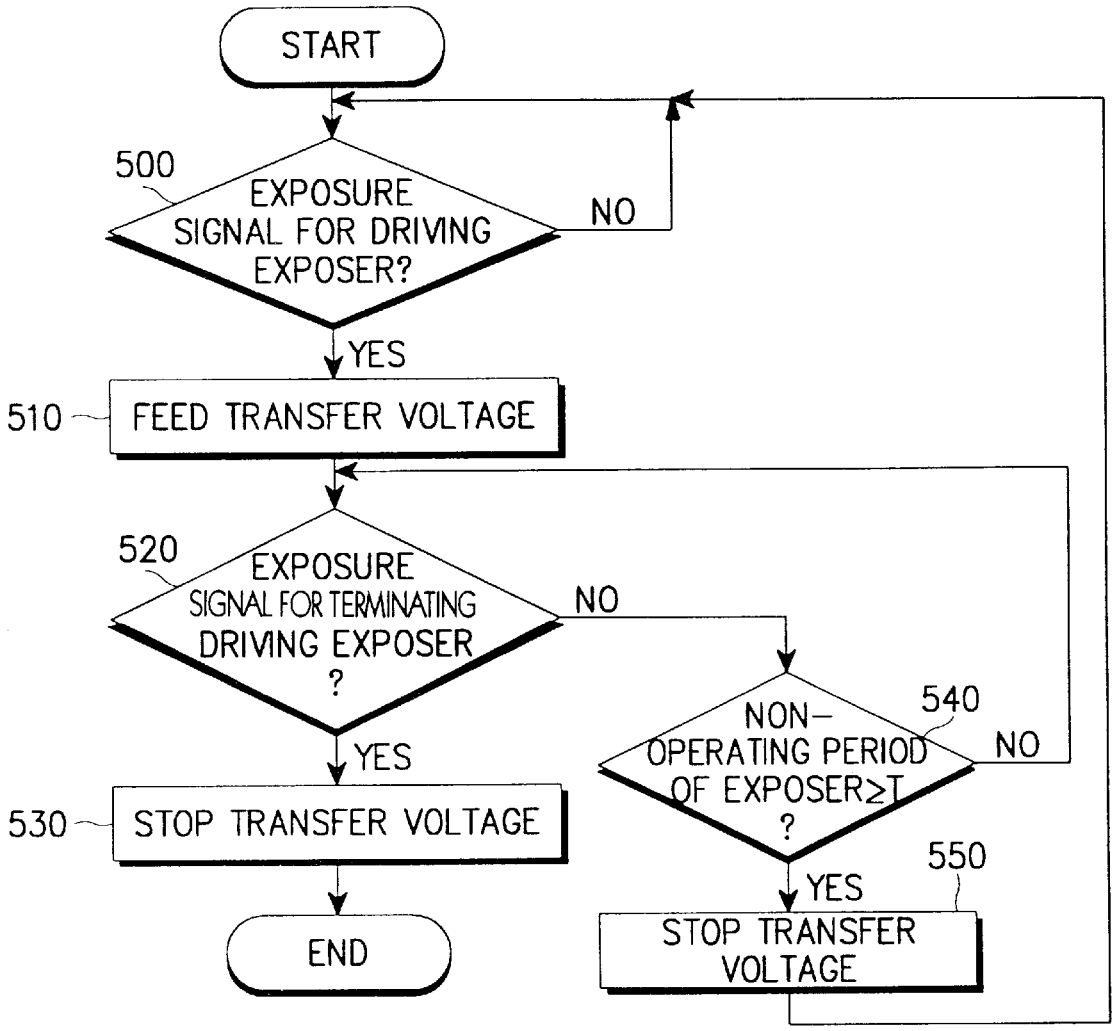
FIG. 5 is a flowchart of a control operation for feeding a transfer voltage according to another embodiment of the present invention.
Figures 6A, 6B:
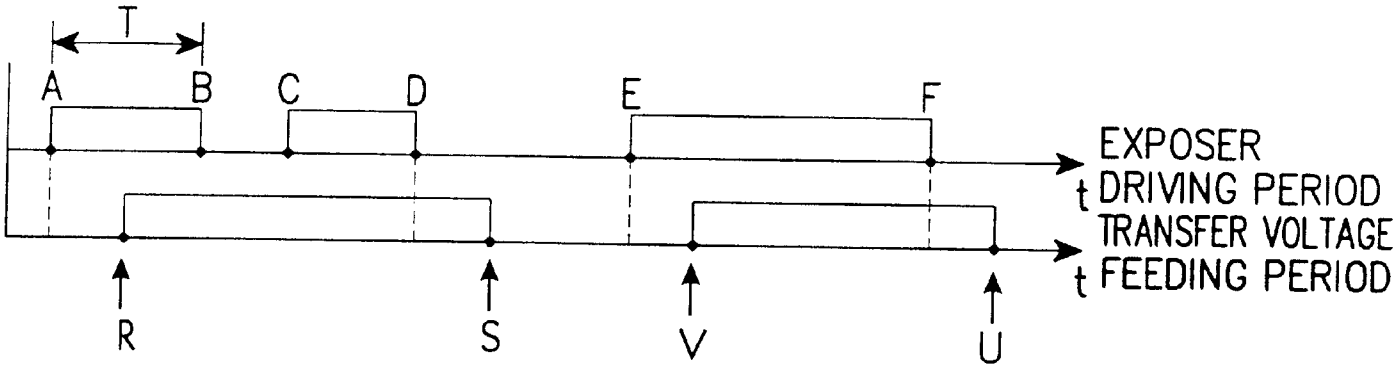
FIGS. 6A–6B are timing diagrams of signals according to another embodiment of the present invention, with FIG. 6A illustrating an exposer driving period and FIG. 6B illustrating a transfer voltage feeding period according to the present invention.

Referring now to FIGS. 5, 6A and 6B, FIG. 5 is a flowchart of a control operation for feeding a transfer voltage according to another embodiment of the present invention, and FIGS. 6A–6B are timing diagrams of signals according to a second embodiment of the present invention, with FIG. 6A illustrating an exposer driving period and FIG. 6B illustrating a transfer voltage feeding period according to a the present invention. In FIGS. 6A and 6B, the arrow on the horizontal axis indicates a direction of increasing time t.

Continuing with reference to FIGS. 1, 2, 5, 6A and 6B, in this second embodiment of a method and apparatus of the present invention, a transfer voltage is fed to the transfer roller 160 in synchronization with an exposure signal of the exposer 140 only for a print data-present portion of a page when the page is to be printed, and if the exposure signal is not generated for a predetermined time period T or longer, the transfer voltage is stopped.

Referring to FIGS. 1, 2, 5, 6A and 6B, the engine controller 221 determines whether an exposure signal a first exposure signal, for driving the exposer 140 is to be output, in step 500. An exposure signal output time corresponds to a point A in an exposer driving period of FIG. 6A. In step 510, the engine controller 221 generates a first control signal that drives the high voltage generator 281 to feed a transfer voltage to the transfer roller 160, in response to output of the first exposure signal. It is to be noted here that the transfer voltage can be provided with some time delay as shown in FIG. 6B for the reason described in connection with the first embodiment, the transfer voltage feeding or supplying periods from R to S and from V to U being illustrated in FIG. 6B. Then, the engine controller 221 determines whether an exposure signal, a second exposure signal, for terminating the operation of the exposer 140 is to be output, in step 520. The time when this second exposure signal is output corresponds to a point F in the exposer driving period in FIG. 6A, for example. Upon the presence of this second exposure signal for terminating the operation of the exposer 140, the procedure goes to step 530, while upon absence of the second exposure signal, the procedure goes to step 540. In step 530, the engine controller 221 generates a second control signal that stops the transfer voltage from being fed to the transfer roller 160. Similarly to the first embodiment, the transfer voltage can be stopped with some time delay as shown in FIG. 6B.

If a second exposure signal for terminating the operation of the exposer 140 is not present in step 520 the procedure or process proceeds to step 540 where, in step 540, the engine controller 221 determines whether the exposer 140 does not operate for the predetermined time period T or longer. The time period T can be determined typically depending on energy efficiency and hardware performance, as well, with an example of the predetermined time period T being illustrated in FIG. 6A. Consideration of the energy efficiency involves a comparison between an energy consumed for applying a transfer voltage and an energy required for obtaining an intended output voltage by re-driving a high voltage generator after the transfer voltage is stopped. The hardware performance indicates the capability of providing and stopping a high voltage, and reducing the time required for obtaining an intended stable voltage by driving the high voltage generator 281. If the exposer 140 does not operate for the time period T or longer in step 540, the process or procedure goes to step 550. If it does not operate for a time shorter than time period T, the process or procedure returns to step 520. In step 550, the engine controller 221 generates a second control signal that stops provision of the transfer voltage by controlling the high voltage generator 281 or a switching circuit 282 between the high voltage generator 281 and the transfer roller 160, and the process or procedure then returns to step 500 for awaiting a first exposure signal to be output for driving the exposer 140. FIGS. 6A and 6B show that the transfer voltage is provided for the period between B and C, shorter than T, but stopped during the period between D and E, longer than T, but the transfer voltage is again applied during the period between E and F.

In FIGS. 6A and 6B, an exposure signal, a first exposure signal, for driving the exposer 140 is output at the time point A, when, in response to the first exposure signal, the engine controller 221 starts to supply a transfer voltage to the transfer roller 160 by driving the high voltage generator 281. The transfer voltage is provided for the period between B and C, shorter than T, but stopped during the period between D and E, longer than T. Finally, the transfer voltage is terminated in response to output of a signal, a second exposure signal, indicating complete printing of the page at a time point F. Further, as inferred from FIGS. 6A and 6B, and from the flowchart of FIG. 5, the process or procedure can provide for a plurality of exposure signals other than the initial first exposure signal at point A, for example, for driving the exposer 140 and a plurality of exposure signals for stopping the operation of the exposer 140, other than the final second exposure signal at point F for finally terminating the operation of the exposer 140. Also, as inferred from FIGS. 5, 6A and 6B, the engine controller 221 can provide a plurality of first control signals to start provision of the transfer voltage and a plurality of second control signals to stop provision of the transfer voltage, with FIG. 6B illustrating the transfer voltage feeding or supplying periods as being from R to S and from V to U, for example.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A transfer voltage controlling device in an electrophotographic recording apparatus, comprising:

a high voltage generator for generating a transfer voltage;

an organic photoconductive drum on which an image is formed for printing;

an exposer for exposing a surface of the organic photoconductive drum to form an image on the surface of the organic photoconductive drum in response to a first exposure signal for starting an exposure to form the image and in response to a second exposure signal for stopping the exposure to form the image;

a transfer roller for transferring the image formed on the surface of the organic photoconductive drum by pressure with the transfer voltage supplied from the high voltage generator; and an engine controller for generating the first exposure signal for starting an exposure to form the image for a page on which the image is to be printed and for generating the second exposure signal for terminating the exposure to form the image for the page on which the image is to be printed, and for causing the high voltage generator to selectively supply the transfer voltage to the transfer roller dependent upon generation of the first exposure signal and to selectively stop the supply of the transfer voltage to the transfer roller dependent upon generation of the second exposure signal.

2. The transfer voltage controlling device of claim 1, further comprising a memory for storing a first time required for an exposed portion of the organic photoconductive drum to reach the transfer roller and for storing a second time required for the transfer voltage supplied to the transfer roller to reach a stable level, and wherein the engine controller is also for generating a first control signal to cause the high voltage generator to start the supply of the transfer voltage to the transfer roller at a time point determined by a sum of the first time and a time when the first exposure signal is output from the engine controller to the exposer and then subtracting the second time from the sum.

3. The transfer voltage controlling device of claim 2, wherein the memory is also for storing a third time required for completely transferring a toner image with the transfer voltage supplied to the transfer roller and for storing a fourth time required for a last exposed portion of the organic photoconductive drum to reach the transfer roller, and wherein the engine controller is also for generating a second control signal to cause the high voltage generator to stop the supply of the transfer voltage to the transfer roller at a time point determined by a sum of the third time, the fourth time and a time when the second exposure signal is output from the engine controller to the exposer.

4. The transfer voltage controlling device of claim 1, further comprising a memory for storing a toner image transfer time required for completely transferring a toner image with the transfer voltage supplied to the transfer roller and for storing a last exposed portion time required for a last exposed portion of the organic photoconductive drum to reach the transfer roller, and wherein the engine controller is also for generating a control signal to cause the high voltage generator to stop the supply of the transfer voltage to the transfer roller at a time point determined by a sum of the toner image transfer time, the last exposed portion time and a time when the second exposure signal is output from the engine controller to the exposer.

5. A transfer voltage controlling method in an electrophotographic recording apparatus for printing on a page, comprising the steps of:

sensing a time when a first exposure signal for initially driving an exposer is generated;

starting to supply a transfer voltage to a transfer roller dependent upon generation of the first exposure signal;

sensing a time when a second exposure signal for terminating the operation of the exposer for the last time is generated; and stopping the supply of the transfer voltage to the transfer roller dependent upon generation of the second exposure signal.

6. The transfer voltage controlling method of claim 5, further comprising the steps of:

continuously supplying the transfer voltage to the transfer roller if an exposure signal is absent for a time period shorter than a predetermined time period; and stopping the supply of the transfer voltage to the transfer roller if an exposure signal is absent for a time period at least equal to the predetermined time period.

7. The transfer voltage controlling method of claim 6, further comprising the step of resuming the supply of the transfer voltage to the transfer roller upon output of an exposure signal after stopping the supply of the transfer voltage to the transfer roller.

8. A transfer voltage controlling method in an electrophotographic recording apparatus for printing on a page, comprising the steps of:

generating a first exposure signal for starting an exposure for forming an image;

supplying a transfer voltage to a transfer roller for transferring the image in response to generation of the first exposure signal;

generating a second exposure signal for terminating the exposure for forming the image; and stopping the supplying of the transfer voltage to the transfer roller in response to generation of the second exposure signal.

9. The transfer voltage controlling method of claim 8, further comprising the steps of:

generating a first control signal for starting the supplying of the transfer voltage to the transfer roller at a time point determined by a sum of a time required for an exposed portion of an organic photoconductive drum to reach the transfer roller and a time when the first exposure signal is generated and then subtracting from the sum a time required for the transfer voltage supplied to the transfer roller to reach a stable level; and generating a second control signal for stopping the supplying of the transfer voltage to the transfer roller at a time point determined by a sum of a time required for a last exposed portion of the organic photoconductive drum to reach the transfer roller, a time required for completely transferring a toner image with the transfer voltage supplied to the transfer roller and a time when the second exposure signal is generated.

10. The transfer voltage controlling method of claim 8, further comprising the steps of:

continuously supplying the transfer voltage to the transfer roller if an exposure signal is absent for a time period shorter than a predetermined time period; and stopping the supplying of the transfer voltage to the transfer roller if an exposure signal is absent for a time period at least equal to the predetermined time period.

11. The transfer voltage controlling method of claim 10, further comprising the step of resuming the supplying of the transfer voltage to the transfer roller upon generation of an exposure signal after stopping the supplying of the transfer voltage to the transfer roller.

12. A transfer voltage controlling apparatus for electrophotographic printing, comprising:

a high voltage generator for generating a transfer voltage;

an exposer for starting and stopping an exposure in response to a first exposure signal and a second exposure signal, respectively;

a transfer roller for transferring an image by high pressure with the transfer voltage supplied from the high voltage generator; and an engine controller for generating the first exposure signal for starting an exposure for a page to be printed and for generating the second exposure signal for terminating the exposure for the page to be printed, and for causing the high voltage generator to selectively supply and stop the transfer voltage to the transfer roller in response to generation of the first exposure signal and the second exposure signal, respectively.

* * * * *